United States Patent [19]

Tomassi et al.

[11] Patent Number: 4,498,582

[45] Date of Patent: Feb. 12, 1985

[54] ARTICLE CARRIER

[75] Inventors: Roberto Tomassi, Chateauroux; Claude Martin, Deols, both of France

[73] Assignee: The Mead Corporation, Dayton, Ohio

[21] Appl. No.: 592,745

[22] Filed: Mar. 23, 1984

Related U.S. Application Data

[63] Continuation of Ser. No. 403,111, Jul. 29, 1982.

[51] Int. Cl.[3] ..... B65D 5/02

[52] U.S. Cl. ..... 206/427; 206/144; 206/146; 206/434; 206/196; 229/28 BC; 229/29 R; 229/40; 229/DIG. 9

[58] Field of Search ..... 206/139, 140, 141, 145, 206/146, 155, 174, 175, 177, 178, 179, 193, 194, 196, 199, 427; 229/28 BC, 29 R, 29 B, 29 E, 29 D, 29 F, 40, DIG. 9

[56] References Cited

U.S. PATENT DOCUMENTS 3,066,795 12/1962 Mansfield ..... 206/139
3,394,800 7/1968 Brackett et al. ..... 206/147

*Primary Examiner*—George E. Lowrance
*Assistant Examiner*—Jimmy G. Foster
*Attorney, Agent, or Firm*—Rodgers & Rodgers

[57] ABSTRACT

A wraparound type article carrier for use in connection with a plurality of articles comprising top, bottom and side walls interconnected to form a sleeve, a closure element preferably in the form of a sleeve enveloping one or more articles at one end of the carrier, the closure sleeve comprising a main panel and an auxiliary panel foldably joined along the upper edge thereof, and the auxiliary panel being angularly related to the main panel and extending inwardly of the carrier.

2 Claims, 9 Drawing Figures

ARTICLE CARRIER

This is a continuation of application Ser. No. 403,111 filed July 29, 1982.

TECHNICAL FIELD

This invention relates to carriers for the packaging of multiple articles such as bottles and which is particularly suitable for protecting bottled beverages whose organoleptic properties can be affected by ultraviolet light.

BACKGROUND ART

Article carriers which are similar to this invention are known in the prior art, for example, such as those disclosed in U.S. Pat. No. 1,888,855; 2,205,437; 3,217,924; 3,337,045; and 4,119,902.

DISCLOSURE OF THE INVENTION

According to this invention a wraparound type article carrier for use in connection with a plurality of articles is provided and comprises an end closure element associated with or attached to at least one article disposed at one end of the carrier. In the preferred embodiment illustrated, the end closure element is in the form of a closure sleeve comprising a main panel and an auxiliary panel, the auxiliary panel being joined along the upper edge of the main panel, and the auxiliary panel being angularly related to the main panel.

BEST MODE FOR CARRYING OUT THE INVENTION

Figure 3:
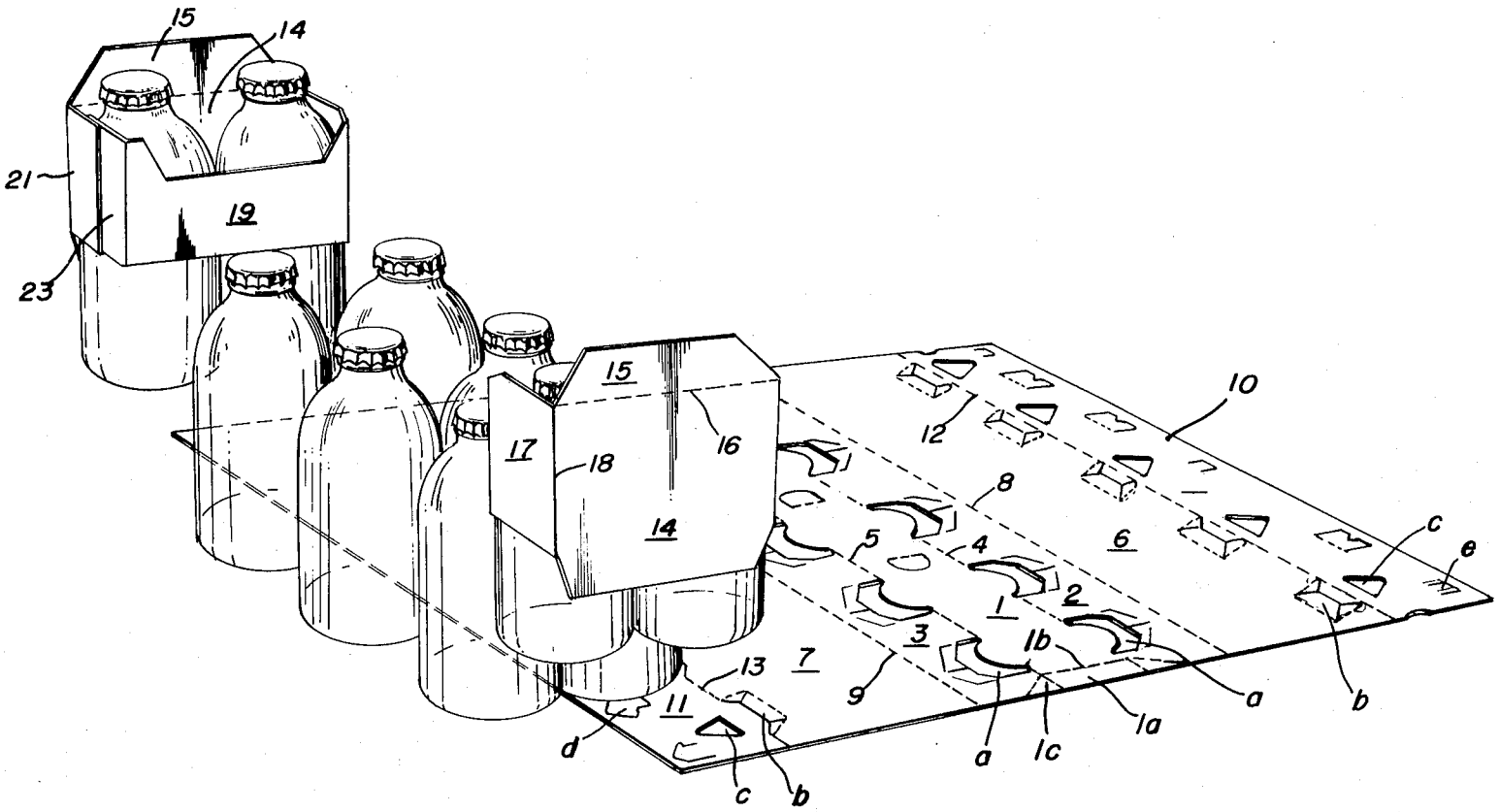
FIGS. 3 and 4 depict intermediate stages of the formation of the carrier.

In the drawings and with particular reference to FIG. 3 the basic blank for the carrier is shown. More specifically the numeral 1 designates the top wall of the carrier to the side edges of which sloping panels 2 and 3 are joined respectively along fold lines 4 and 5. At each end of top wall 1, an end panel 1*a* is joined thereto along fold line 1*b*. End panels 1*a* are further joined to the sloping panels be means of web panels 1*c*. Side walls 6 and 7 are joined to lower edges of sloping panels 2 and 3 along fold lines 8 and 9. To complete the basic elements of the carrier, bottom wall panels 10 and 11 are foldably joined to the lower edges of side walls 6 and 7 respectively along fold lines 12 and 13.

As is well known, multiple neck receiving apertures a are formed in sloping panels 2 and 3 and, in similar fashion, multiple heel receiving apertures b are formed in the lower portions of side walls 6 and 7. Also as is well known, machine tightening apertures c are formed in bottom wall panels 10 and 11; locking tabs d are formed in bottom wall panel 11 and locking apertures e are formed in bottom wall panel 10.

According to this invention, a closure sleeve is provided and comprises main panel 14. To the top edge of main panel 14, auxiliary panel 15 is joined thereto along fold line 16. Similarly side panel 17 is joined to a side edge of main panel 14 along fold line 18. Back panel 19 is joined to side panel 17 along fold line 20 and a nesting notch 19*a* is formed along the upper portion thereof. Composite panel 21 is joined to main panel 14 along fold line 22 and composite panel 23 is joined to back panels 19 along fold line 24. Composite panels 21 and 23 combine to form the side panel of the closure sleeve opposite side panel 17. In order to accomplish economy of material, the closure sleeve shown in FIG. 7 can be nested with an adjacent closure sleeve by means of the cooperation between auxiliary panel 15 of one blank and nesting notch 19*a* of an adjoining blank as shown by the phantom lines in FIG. 7.

Figure 7:
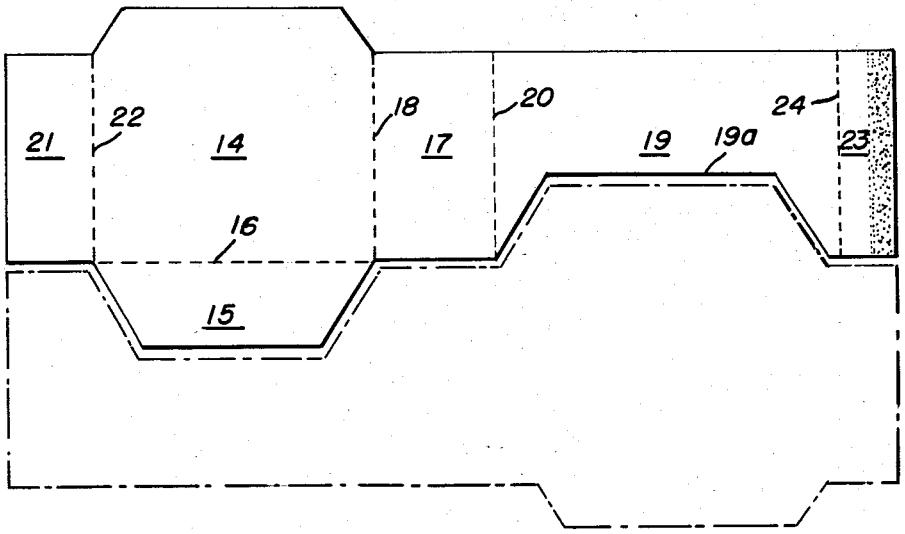
FIG. 7 is a plan view of a pair of closure sleeve blanks shown in a nested condition.

In order to form the closure sleeve from the blank shown in FIG. 7, it is necessary to make an application of glue to composite panel 23 as shown by stippling in FIG. 7. Then the blank of FIG. 7 is manipulated to a position whereby composite panel 23 is adhered to composite panel 21 and the elements of the blank are disposed in positions whereby main panel 14 and back panel 19 are parallel and, similarly, side panel 17 is parallel to side panel 21, 23.

Figure 1:
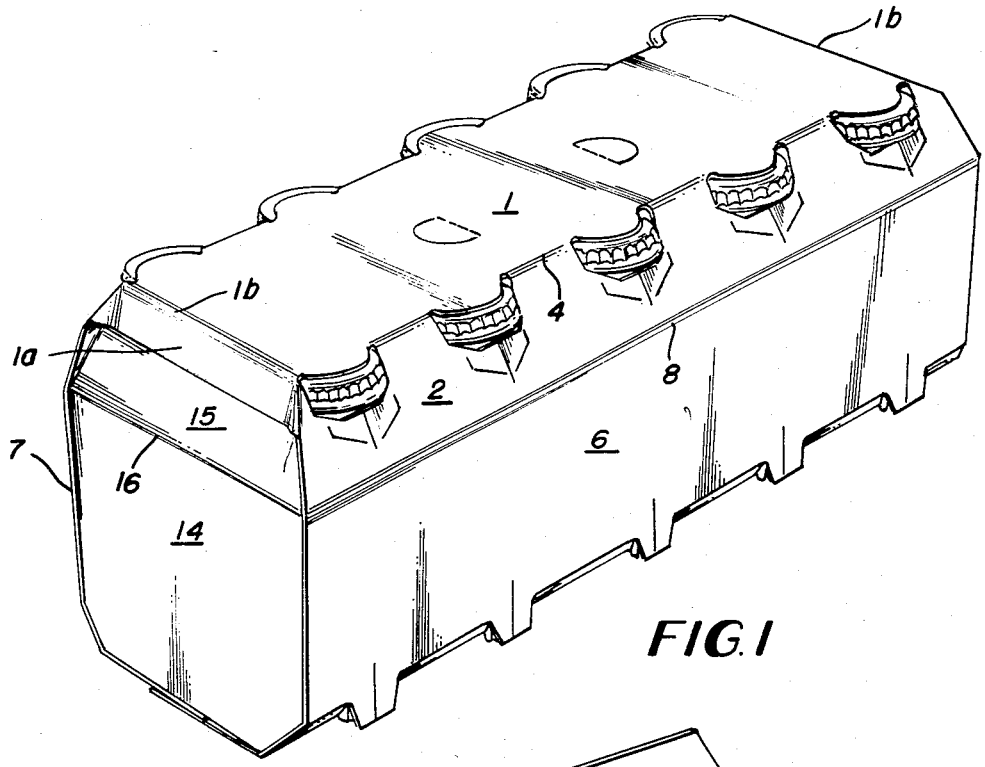
FIG. 1 is a perspective view of an article carrier formed according to this invention.
Figure 2:
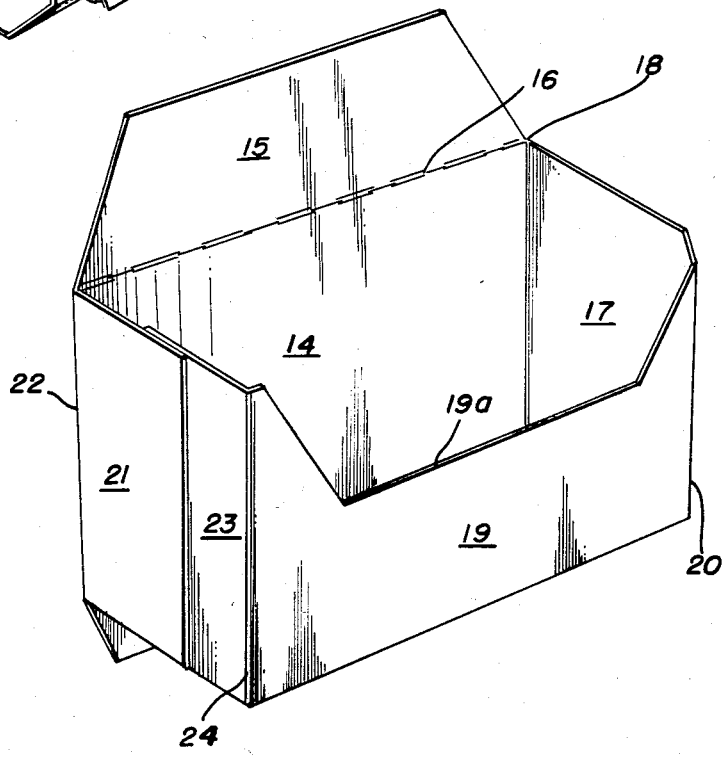
FIG. 2 is a perspective view of one form of the closure sleeve formed according to this invention.
Figure 4:
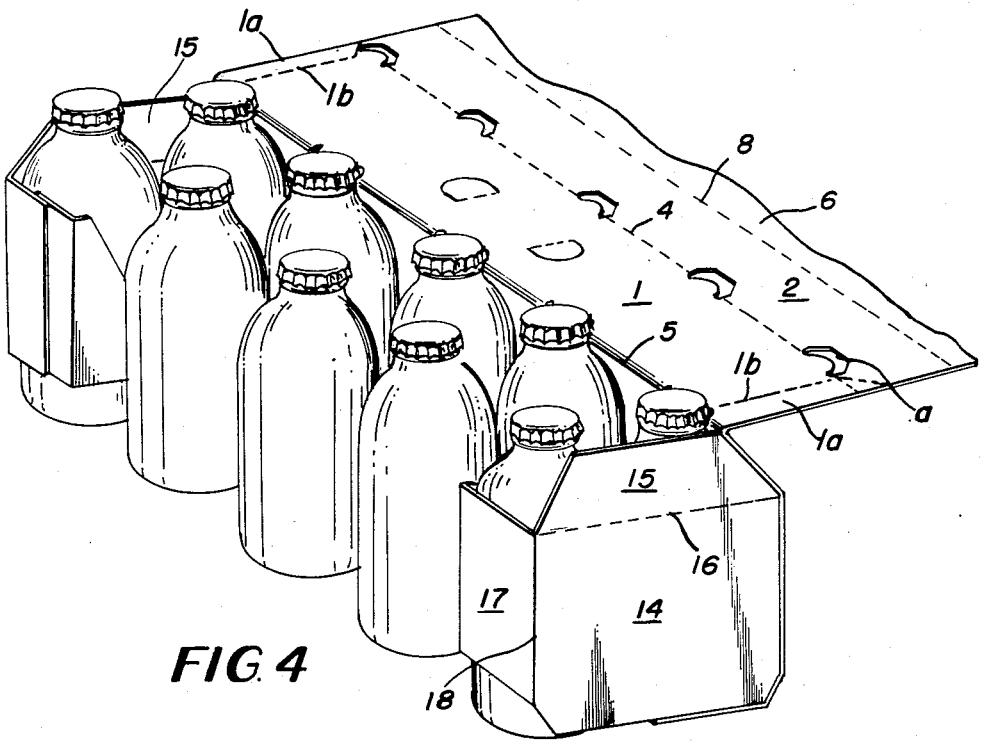
Figure 5:
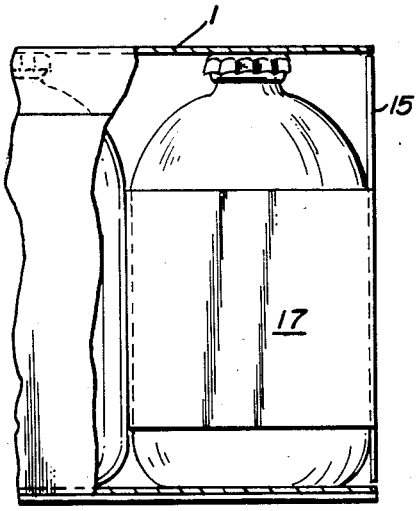
FIGS. 5 and 6 are side views of a portion of the carrier with part of one side wall broken away.
Figure 6:
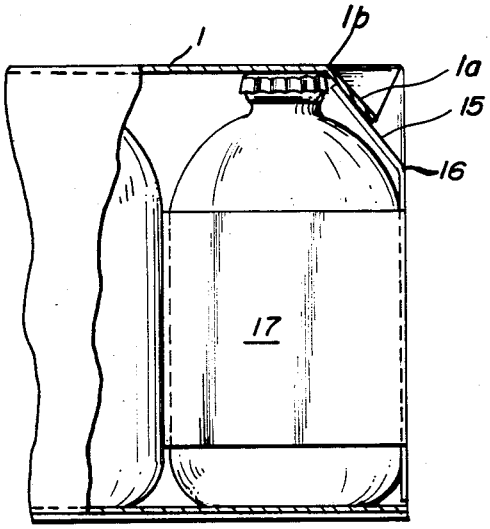

To complete formation of the carrier, the aricles to be packaged are placed on a carrier blank as shown in FIG. 3. Following this operation a closure sleeve as shown in FIG. 2 is simply slipped over the end two articles at each end of the carrier as shown in FIG. 4. Then the elements of the main blank are simply wrapped around the articles whereby the necks of the articles are inserted into article or neck receiving apertures a and the heels of the articles are inserted into article or heel receiving apertures b. Then the blank is simply locked in position by the known cooperation between locking tabs d and locking apertures e. In order to complete the carrier, auxiliary panel 15 is folded inwardly of the carrier along fold line 16 and the end panels 1*a* are folded downwardly respectively in overlapping face contacting relation with the outer surface of auxiliary panels 15. Auxiliary panel 15 is then disposed at an angle greater than 90° to the inner surface of main panel 14. This operation is best shown in FIGS. 5 and 6. The carrier then appears as shown in FIG. 1 and the contents thereof are protected from the damaging effects of light. This invention would also be well adapted for use in connection with a wraparound carrier of the shrink film variety.

Figure 8:
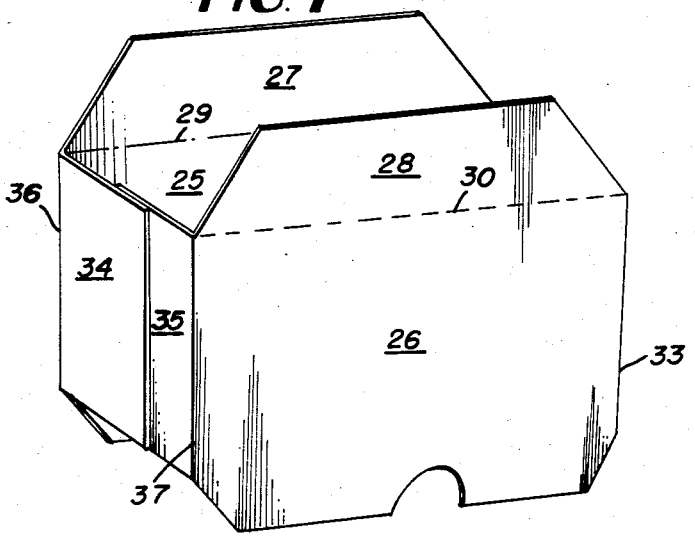
FIG. 8 is a perspective view of a modified form of the closure sleeve.
Figure 9:
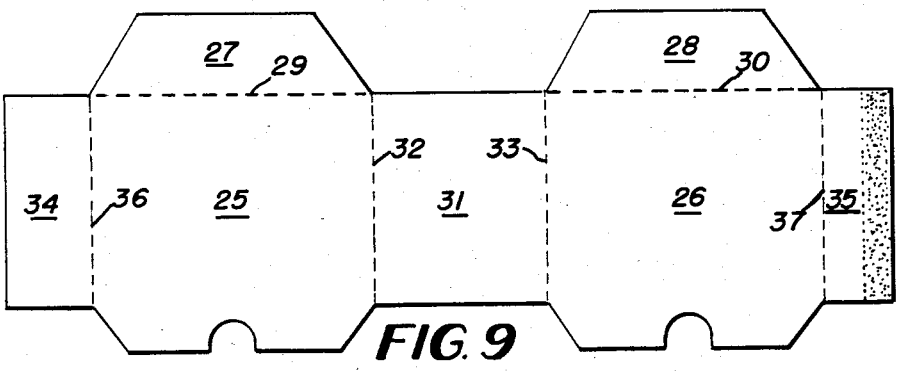
FIG. 9 is a plan view of the blank from which the closure sleeve of FIG. 8 is formed.

The modified form of the closure sleeve is shown in FIGS. 8 and 9. More specifically this version of the closure sleeve comprises dual main panels 25 and 26. Auxiliary panels 27 and 28 are foldably joined respectively to main panels 25 and 26 along fold lines 29 and 30. Also side panel 31 is joined to main panels 25 and 26 respectively along fold lines 32 and 33. The opposite side panel comprises composite panels 34 and 35 which are joined respectively to main panels 25 and 26 along fold lines 36 and 37. To form the closure sleeve as shown in FIG. 8, it is simply necessary to adhere composite panel 34 to composite panel 35 as described in connection with the closure sleeve shown in FIG. 7.

While a sleeve is shown and described as end closure means, it will be understood that for some applications of the invention some sleeve panel elements may be omitted and other suitable means could be employed to hold the closure panel in attached relation to one or more end articles.

INDUSTRIAL APPLICABILITY

By this invention an article carrier is provided which is especially well adapted for the packaging of bottled products such as beer which are extremely sensitive to the effects of light.

We claim:

1. A wraparound type article carrier having a plurality of articles disposed in a side by side rectilinear arrangement and secured therein by article retaining apertures formed in said carrier for receiving parts only of the heels and tops of the packaged articles and comprising a pair of side walls, a unitary top wall overlying the tops of the packaged articles, and a bottom wall interconnected to form a sleeve, and a pair of unitary end panels foldably joined respectively to the ends of said top wall, a separate tubular closure element telescoped over at least one article disposed at one end of the carrier and secured in place by said article, said closure element comprising a main panel of a size and configuration to substantially close an end of the carrier, an auxiliary panel foldably joined directly to the upper edge of said main panel, a pair of side panels joined respectively to the end edges of said main panel, and a back panel joined to the edges of said side panels remote from said main panel to form said tubular closure element, said auxiliary panel extending inwardly of said carrier at an angle greater than 90° to the inner surface of said main panel, and one of said end panels being disposed in overlapping face contacting relationship with said auxiliary panel to form a substantially complete closure for the acjacent end of the carrier, said closure element being retained within said sleeve by the article disposed at said one end and the end article being retained in said carrier by said article retaining apertures formed in the carrier.

2. An article carrier according to claim 1 wherein a nesting notch is formed in said back panel along the upper portion thereof.

* * * * *